United States Patent [19]

Grogan

[11] 4,138,038

[45] Feb. 6, 1979

[54] DISPENSING PUMP HOUSING AND OPERATING LEVER ASSEMBLY

[75] Inventor: Richard P. Grogan, Ontario, Calif.

[73] Assignee: Diamond International Corporation, New York, N.Y.

[21] Appl. No.: 817,864

[22] Filed: Jul. 21, 1977

[51] Int. Cl.[2] ..... B05B 11/00

[52] U.S. Cl. ..... 222/207; 222/214; 222/383; 222/472

[58] Field of Search ..... 222/207, 209, 214, 383, 222/472, 473, 474, 505, 402.13, 402.15, 79; 239/526, 527, 528

[56] References Cited

U.S. PATENT DOCUMENTS

| | | | |
|---|---|---|---|
| 3,112,849 | 12/1963 | Wallace | 222/474 UX |
| 3,506,159 | 4/1970 | Müller | 222/473 X |
| 3,995,774 | 12/1976 | Cooprider et al. | 222/214 X |

FOREIGN PATENT DOCUMENTS

| | | | |
|---|---|---|---|
| 1160204 | 8/1969 | United Kingdom | 239/526 |

*Primary Examiner*—Robert B. Reeves
*Assistant Examiner*—Francis J. Bastuska
*Attorney, Agent, or Firm*—Watson, Cole, Grindle & Watson

[57] ABSTRACT

A dispensing pump of the type having opposing pump housing members and a trigger for actuating a variable volume pump chamber, the trigger being mounted on one of the members for pivotal movement as a trigger trunnion bears against bracket seats on the one housing member. The pair of leg members on the other housing member bear against the trunnion for maintaining it seated against the brackets so as to facilitate pivotal movement of the trigger.

3 Claims, 3 Drawing Figures

12
P
12a
34
14b
14d
24
14c
14a
14
25
26
33
13a
19
13
32
29
27
16
21
22
15
23

34
33
34
26
27
28
29
31
21
15

3
35
33
14d
12
14c
P
34
36
24
25
17
16
21
13
29
22
15
3
10
11
23
18
C

DISPENSING PUMP HOUSING AND OPERATING LEVER ASSEMBLY

BACKGROUND OF THE INVENTION

This invention relates generally to a trigger-actuated dispensing pump, and more particularly to a housing assembly for the pump.

U.S. Pat. No. 3,995,774, commonly owned herewith, discloses a dispensing pump of the type having a trigger for actuating a deformable diaphragm clamped between a pair of opposing pump housing members. The trigger is fulcrumed on the lower housing member by means of a pivot pin received within pin openings. A free end of the lever is moveable into operative engagement with the diaphragm, and the other end of the lever constitutes a manually operable trigger for actuating the pump. Another dispensing pump of the trigger-actuated type having a variable volume pump chamber defined by other than a deformable diaphragm is disclosed in U.S. Pat. No. 3,840,157. The trigger is likewise fulcrumed to the housing member y means of a pivot pin extending through the trigger and opposing side walls of the housing.

In the dispensing pumps which are typified by the above-mentioned patents, the trigger must be carefully installed as its pivot pin is implanted within pin openings. To facilitate a rapid assembly of the various parts of the housing assembly, and because of the delicate moulding steps required, improvement in the assembly operation of the housing parts is desirable. The trigger must be mounted for pivotal movement and maintained seated in place without complicating the design of the housing, or destroying the effectiveness of the trigger-actuated pump.

SUMMARY OF THE INVENTION

It is therefore an object of the present invention to provide a housing assembly for a trigger-actuated dispensing pump wherein the trigger engages with one of the pump housing members for pivotal movement and is maintained seated against removal upon the final assembly of the other housing member.

In carrying out this objective, the trigger or pump actuating lever is captivated on the one housing member and is maintained seated thereon for pivotal movement as a portion of the other housing member engages a portion of the lever. The one member has a bearing seat thereon in the form of a pair of brackets so that the lever portion in the form of a trunnion pivotally engages such a seat. The above-mentioned portion of the other housing member includes a pair of leg members which bear against the trunnion for maintaining it in engagement with its seat. These leg members extend between opposing side walls of the one housing member on which the brackets are mounted so that, after the trigger trunnion is seated in place, the leg members bear against the seated trunnion upon final assembly of the other housing member to facilitate pivotal movement of the lever.

Other objects, advantages and novel features of the invention will become more apparent from the following detailed description of the invention.

DETAILED DESCRIPTION OF THE INVENTION

Figure 1:
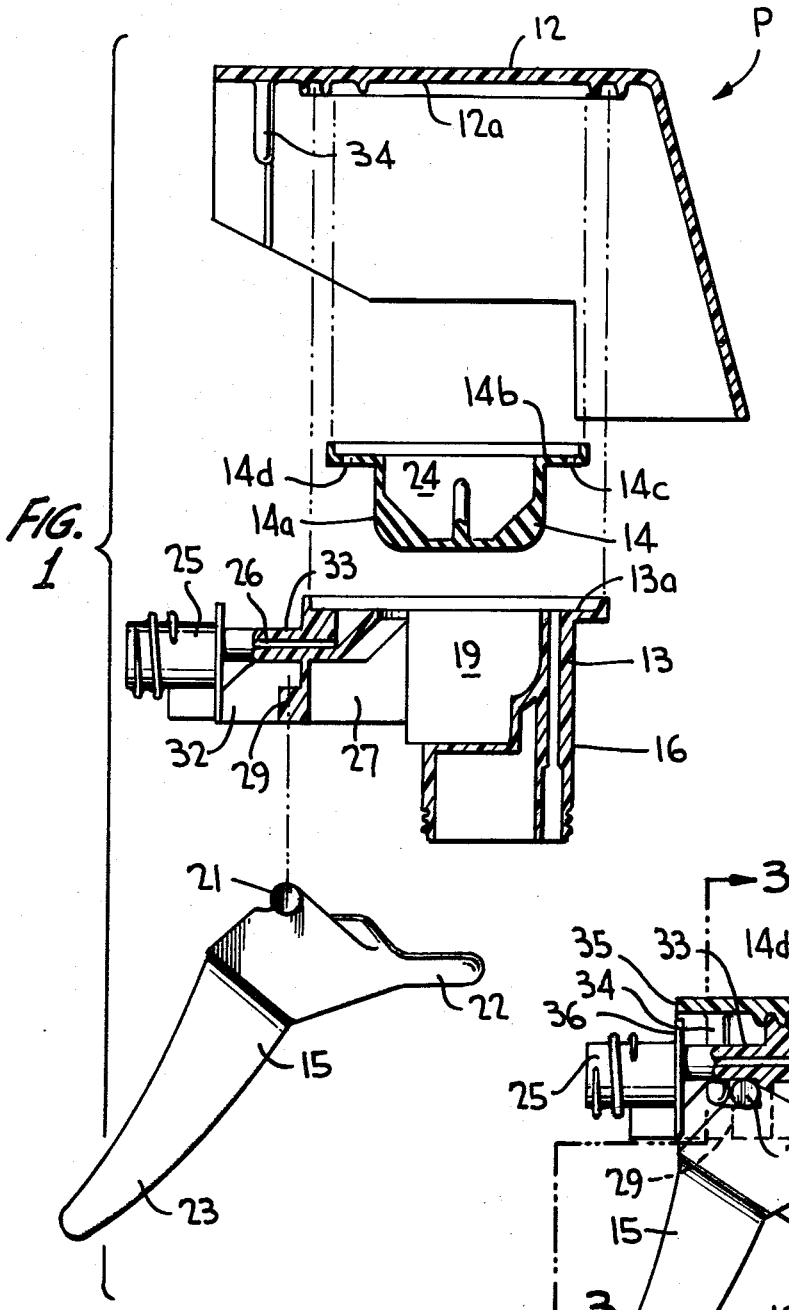
FIG. 1 is an expanded side elevational view of the pump housing assembly according to the invention.

Turning now to the drawings wherein like reference characters refer to like and corresponding parts throughout the several views, the pump housing generally designated P is mounted in any normal manner on a container generally designated C by means of a threaded container cap 10 and a cylindrical sleeve 11.

The pump comprises upper and lower housing members 12 and 13, interconnected in fluid tight manner upon assembly of resilient diaphragm 14 and lever or trigger 15, in a manner which will become more clearly apparent hereinafter.

Figure 2:
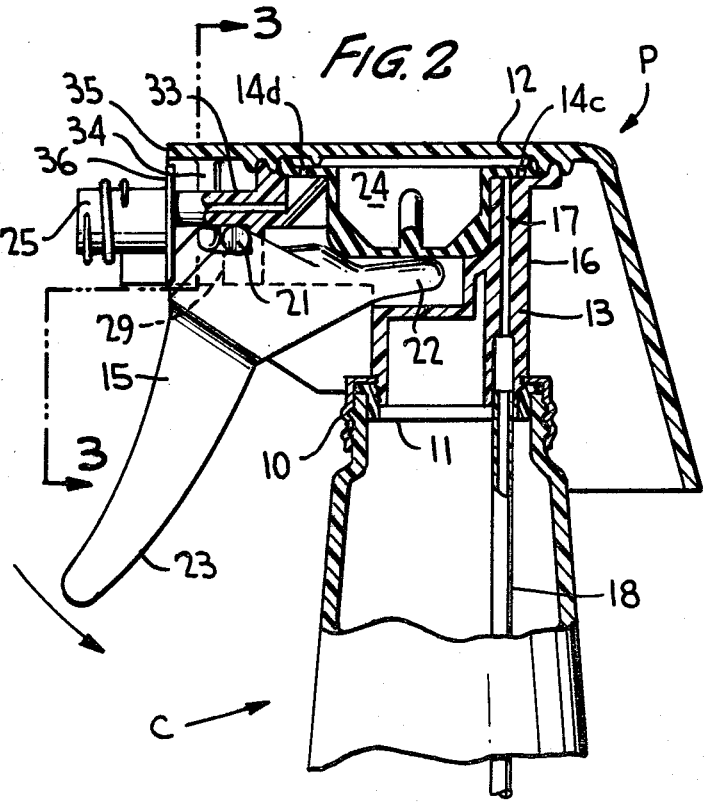
FIG. 2 is an assembled side elevational view of the parts shown in FIG. 1 as mounted on a supply container.

Lower housing member 13 includes a plug 16 threaded at its lower end for threaded engagement with cap 10 and sleeve 11, as shown in FIG. 2. The plug has an intake passage 17 in communication with a conventional dip tube 18 fitted into the lower end of the intake passage and communicating with the lower end portion of the container.

An opening 19 is provided in the lower housing member for the reception of a deformable dome portion **14*a* of a resilient diaphragm 14, which is accessible for deformation to actuate the pump. The diaphragm includes an encircling marginal flange 14*b* clamped between opposing clamping surfaces 12*a* and 13*a* of the interconnected housing members. The lower housing member is provided with a depression which conforms in shape to the diaphragm flange, and the upper housing member is provided at its undersurface 12*a*** with a recess in alignment with the intake passage and an outlet passage, all as typically disclosed in the aforementioned U.S. Pat. No. 3,995,774, the entire disclosure of which is specifically incorporated herein by reference. Thus, the details of these elements will not be specifically described here in the interest of clarity.

The depending convex side of dome **14*a* depends through openings 19 into the lower housing member and is accessible through this opening for deformation by means of lever 15 which has a transversely disposed pin or trunnion 21 thereon to facilitate a pivotal mounting of the trigger on the lower housing. A free end 22 of the trigger is swingable through opening 19 into operative engagement with the domed portion of the diaphragm, such that by pulling opposite end 23 of the trigger in a counterclockwise direction as viewed in FIG. 2, the diaphragm will be deformed to reduce the volume of pump chamber 24** which is defined by the diaphragm and the upper housing member.

The lower housing is further provided with a nozzle 25 having a discharge passage 26 and a discharge orifice (not shown), the discharge passage being in communication with the discharge port defined in the undersurface **12*a* of the upper housing member, similarly as disclosed in the aforementioned U.S. Pat. No. 3,995,774 and illustrated at 38** therein.

The inlet passage terminates in an upwardly directed inlet port located beneath flange **14*b* of the diaphragm, which flange normally extends across and closes the port. An aperture or hole 14*c* in the diaphragm flange is located to one side of the inlet port. This hole defines a locally deformable portion of the diaphragm flange normally seated over and closing the inlet port, but capable of being unseated by fluid pressure therebeneath to function as an inlet valve admitting outward flow of liquid from passage 17 through hole 14***c*, and thence into a recess (not shown) in the lower surface 12*a* of the upper pump housing member. This recess communicates with one or more grooves or passages (not shown) and with pump chamber 24.

The outlet passage from the pump chamber is controlled in a generally similar manner by a flap outlet valve, which is defined in flange 14*b* of the diaphragm by a suitably located hole in the opposite end portion of the diaphragm flange.

Thus far, the construction and operation of the pump as aforedescribed is substantially the same as that disclosed in U.S. Pat. No. 3,995,774. The present invention, however, is directed to the assembly of the pump housing members and the trigger, and in the manner in which they cooperate to maintain the trigger pivotally mounted in place.

As shown in the drawings, lower housing member 13 includes the pair of spaced side walls 27, 28 lying parallel to discharge passage 26 on opposite sides thereof. Substantially L-shaped brackets 29, 31 are respectively located on the side walls and open in a direction of nozzle 25. The space 32 between the side walls, and between the nozzle and the brackets, is open from below, so as to facilitate insertion of lever trunnion 21 thereinto. The trunnion has a length substantially equal to the spacing of the side walls, and a diameter substantially filling the space between the legs of the brackets and conduit 33 which contains the disclosure passage, thereby permitting the trunnion to be snugly received within such space. It can be therefore seen that, in the assembled condition of FIG. 2, the brackets serve as supports for lever 15, and the trunnion engages the brackets to facilitate pivotal movement of the lever.

Figure 3:
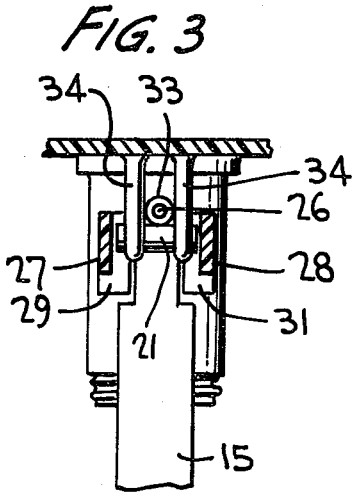
FIG. 3 is a front elevational view of the housing assembly taken substantially along line 3—3 of FIG. 2.

The lower housing member and the lever are assembled together before the upper housing member is assembled since member 12 has a portion which, upon final assembly of the upper housing, bears against the seated trunnion to maintain it in place. Member 12 is provided with a pair of depending leg members or pins 34 spaced apart a distance sufficient to clear conduit 33, and extending toward member 13 so as to protrude through an upper opening provided between the side walls. The leg members are of a length sufficient to bear against the trunnion when in a fully assembled condition as illustrated in FIGS. 2 and 3. The trunnion is therefore maintained seated in place in engagement with brackets 29 and 31. And, the upper and lower housing members may be suitably welded together or otherwise permanently joined between exposed adjoining surfaces thereof, such as between open end 35 of the upper housing and a collar 36 which surrounds the nozzle. Trigger movement of end 23 of the lever therefore functions to actuate the pump diaphragm for the dispensing of the fluid similarly as described in the aforementioned U.S. Pat. No. 3,995,774.

From the foregoing it can be seen that the cooperation between the housing members and the trigger facilitates a simple yet highly effective assembly operation between the parts, which has an advantage over prior assemblies wherein the trigger is more or less permanently fulcrumed to one of the housing members. The brackets on the lower housing member support the lever trunnion which facilitates pivotal movement of the lever. The depending legs on the upper housing member bear against the trunnion to maintain it seated against the brackets in a manner whereby the operating lever cannot become dislodged after the upper and lower housing members are welded or otherwise secured together.

Obviously, many modifications and variations of the present invention are made possible in the light of the above teachings. For example, brackets 29 and 31 may have arcuate inner surfaces against which the trunnion bears. Or, in the cooperation between parts 21 and 29, 31 may be reversed without departing from the scope of the present invention. Such a reversal of parts could include a curved flange in lieu of the trunnion, which flange partially surrounds a pair of cylyndrical pegs provided in lieu of brackets 29 and 31. It is therefore to be understood within the scope of the appended claims, the invention may be practiced otherwise than as specifically described.

What is claimed is:

1. In a dispensing pump of the type in which a resiliently deformable diaphragm clamped between opposing upper and lower pump housing members of the pump housing cooperates with said upper member to define a variable volume pump chamber in which inlet and outlet passages formed in said pump housing define a discharge path for liquid from a supply container through said pump chamber to a discharge nozzle, said diaphragm including an endless resiliently deformable marginal flange clamped in fluid tight manner between said housing members and encircling said pump chamber, said flange including flap valves constituting unitary portions thereof and extending across and normally closing the respective inlet and outlet passages, and an operating lever pivotably mounted on said lower housing member and having a portion movable into operative drformable engagement with said diaphragm to vary the volume of said pump chamber;

the improvement wherein said lower member has a pair of spaced side walls and a discharge nozzle, a lever support comprising L-shaped brackets being provided on said walls and opening into a bottom side of said lower member so as to be accessible from said bottom side;

said lever having a trunnion thereon in engagement with said brackets, said trunnion being movable during assembly into engagement with said brackets from said bottom side of said lower member; and said upper housing member having at least one depending leg member disposed along an open side of said brackets and bearing against said trunnion for maintaining it seated on said brackets.

2. The dispensing pump according to claim 1, wherein said trunnion is disposed medially of said lever, said bottom wall having an access opening lying between said brackets and said nozzle, said brackets opening toward said nozzle, and said trunnion being insertable during assembly through said access opening into engagement with said brackets.

3. The dispensing pump according to claim 1, wherein said upper member has a pair of depending leg members disposed along said open side of said brackets and bearing against said trunnion for maintaining it seated on said brackets.

* * * * *